US006544406B1

(12) United States Patent
Warren et al.

(10) Patent No.: US 6,544,406 B1
(45) Date of Patent: Apr. 8, 2003

(54) ION IMPLANTATION OF ANTIFOULANTS FOR REDUCING COKE DEPOSITS

(75) Inventors: David W. Warren, Sun Valley, CA (US); Michael B. Donahue, Monrovia, CA (US)

(73) Assignee: Harvest Energy Technology Inc., Sun Valley, CA (US)

( * ) Notice: Subject to any disclaimer, the term of this patent is extended or adjusted under 35 U.S.C. 154(b) by 484 days.

(21) Appl. No.: 08/986,449

(22) Filed: Dec. 8, 1997

(51) Int. Cl.[7] ..... C10G 9/16

(52) U.S. Cl. ..... 208/48 R; 208/48 AA; 585/648

(58) Field of Search ..... 208/47, 48 R, 208/48 AA; 585/648, 950

(56) References Cited

U.S. PATENT DOCUMENTS

| | | | | |
|---|---|---|---|---|
| 4,410,418 A | | 10/1983 | Kukes et al. | |
| 4,454,021 A | | 6/1984 | Watanabe et al. | |
| 4,545,893 A | | 10/1985 | Porter et al. | |
| 4,692,313 A | | 9/1987 | Watanabe et al. | |
| 4,714,632 A | * | 12/1987 | Cabrera et al. | 427/255.1 |
| 4,764,394 A | * | 8/1988 | Conrad | 427/38 |
| 4,863,892 A | | 9/1989 | Porter et al. | |
| 5,242,574 A | | 9/1993 | Broutin et al. | |
| 5,358,626 A | * | 10/1994 | Gandman et al. | 208/48 R |
| 5,364,522 A | | 11/1994 | Wang | |
| 5,449,920 A | * | 9/1995 | Chan | 250/492.21 |
| 5,498,657 A | | 3/1996 | Sugiyama et al. | |
| 5,558,718 A | * | 9/1996 | Leung | 118/723 E |
| 5,565,087 A | | 10/1996 | Brown et al. | |
| 5,575,902 A | * | 11/1996 | Heyse et al. | 208/48 R |
| 5,580,429 A | * | 12/1996 | Chan et al. | 204/192.38 |
| 5,616,236 A | | 4/1997 | Brown et al. | |
| 5,693,376 A | * | 12/1997 | Fetherston et al. | 427/523 |

OTHER PUBLICATIONS

Albright, L. F., and W.A. McGill, "Aluminized Ethylene Furnace Tubes Extend", Oil & Gas Journal, Aug. 31, 1987.

Velenyi, L. J., Song, Y;, and J. C. Fagley, "Coke Deposition in Ethane Pyrolysis Reactors", Ind. Eng. Chem. Res., 31, 1708–1712 (1991).

Chowdhury, S.N., and D. Kunzru, "Benzyl Diethyl Phosphite as a Coke Inhibitor During Naphtha Pyrolysis", Tubular Reactor Studies, Can. J. Chem Engr., 71 873–879 (1993.

Vaish, S., and D. Kunzru, "Triphenyl Phosphite as a Coke Inhibitor During Naphtha Pyrolysis", Ind. Eng. Chem. Res., 28, 1293–1299 (1989).

Das, P., Prasad, S., and D. Kunzru, Organophoshorus Compounds as Coke Inhibitors During Naphtha Pyrolysis: Effect of Benzyl Diethyl Phosphite and Triphenylphosphine Sulfide, Ind. Eng. Chem. Res., 31, 2251–2255 (1992).

* cited by examiner

*Primary Examiner*—Bekir L. Yildirim
(74) *Attorney, Agent, or Firm*—William W. Haefliger

(57) ABSTRACT

The formation of coke on metal surfaces exposed to hydrocarbons in a thermal cracking process is reduced by ion implantation of selected antifoulants into such metal surfaces; the antifoulants being chosen from a group of primary elements consisting of aluminum, silicon, and chromium, or combinations thereof, and a group of secondary elements consisting of calcium, lithium, potassium, magnesium, cesium, hafnium, yttrium and zirconium, or combinations thereof.

15 Claims, 7 Drawing Sheets

(NITROGEN / ETHYLENE MIXTURE AS NOTED)

4-HR. STEAM/ETHYLENE COKING TEST

ION IMPLANTATION OF ANTIFOULANTS FOR REDUCING COKE DEPOSITS

BACKGROUND OF INVENTION

This invention relates generally to a method for treating metal surfaces to reduce the formation of carbonaceous deposits, or coke, on furnace or heat exchanger tubes that are exposed to process streams containing hydrocarbons at high temperature. The invention also relates to use of particular antifoulants that are characterized as reducing the rate of coke formation when applied using such treatment methods.

Many refining and petrochemical processes, such as thermal cracking, heavy oil upgrading, and delayed coking, operate under conditions of high temperature and hydrocarbon partial pressure, leading to the formation of coke deposits on critical heat transfer surfaces. These coke deposits act as thermal insulators to substantially increase furnace tube wall temperature. This rise in tube wall temperature reduces heat transfer efficiency, process throughput capacity, and equipment life, and results in increased energy consumption. The coke deposits also result in embrittlement of the tube wall due to carburization of the tube metallurgy.

In one example, ethylene is produced by the thermal cracking of hydrocarbon reactants contained inside of a heated furnace tube. Coke forms on the internal surfaces of the furnace tubes as a by-product of the cracking reactions. As the coke layer grows, the furnace tube wall temperatures rise about 100° C. and furnace fuel consumption increases by 5%. The coke layer also increases the furnace pressure drop, thereby reducing product yield and throughput. When tube wall temperatures approach their design limit, or pressure drops becomes excessive, the furnace tubes must be taken off-line and decoked. For ethane crackers, decoking is commonly required at regular intervals of about 45–60 days. The presence of coke promotes carburization of the tube wall, which in combination with increased tube wall temperature, significantly shortens furnace tube operating life.

Coke growth on clean tube surfaces is catalyzed by the metal constituents, primarily Fe and Ni, contained in the tube alloy. Catalytic coke consists of hollow filaments that contain metal-microparticles located at the filament tips. The accepted mechanism for filament growth involves the catalytic decomposition of hydrocarbons at the metal tip, leading to the formation of atomic carbon which diffuses through the metal and deposits on the opposing side. Because the active metal is carried along at the tip of the growing fiber, the catalytic influence of the substrate is maintained over a period of time. Because the initial coke growth rate is surface dependent, there is an opportunity to eliminate catalytic coke deposition by modifying the chemical nature of the tube surface.

A variety of methods have been proposed to reduce the rate of coke formation in cracking processes. U.S. Pat. Nos. 5,616,236 and 5,565,087 describe use of certain tin and silicon antifoulants in the presence of a reducing gas and certain sulfur compounds. U.S. Pat. No. 5,575,902 describes use of a Group VIB metal protective layer that is anchored to the steel tube through an intermediate carbide-rich bonding layer. U.S. Pat. No. 5,242,574 describes use of metal oxide, metal carbide, metal nitride and metal silicide coatings. U.S. Pat. No. 5,015,358 describes use of certain tin, chromium, and antimony antifoulants. U.S. Pat. Nos. 4,692,313 and 4,454,021 describe use of alkali and alkaline earth inhibitors. U.S. Pat. No. 4,410,418 describes use of certain silicon antifoulants.

Methods described in the prior art for application of antifoulants and coke inhibitors to metal surfaces include electrochemical deposition, chemical vapor deposition; plasma-assisted deposition and thermal diffusion processes. A common drawback of deposition methods is that the treated layer is susceptible to cracking, peeling, and degradation in high temperature thermal cracking processes. It is well known that a mismatch in thermal expansion coefficients between the deposited layer and the metal substrate results in severe mechanical stresses in the coating layer. Furthermore, deposition methods can result in coatings that are not uniformly distributed on the substrate surface or possess microscale defects that increase the likelihood of degradation under corrosive high temperature conditions. Coating methods are needed that overcome the problems of lack of coating adhesion, durability and uniformity. The use of ion implantation as described herein as a method to treat heat resistant alloys with antifoulants for the inhibition of coke formation to accomplish this object has not been described in the prior art.

OBJECTS AND ADVANTAGES

Accordingly, it is an object of the present invention to provide a treatment method for heat resistant alloys to reduce carburization and coke formation in thermal cracking processes by ion implantation of selected elements to form a treated surface layer that is uniform at the atomic scale, adherent to the substrate, and durable under corrosive high temperature conditions.

Objectives and advantages of the invention are:

(I) To provide a treated surface layer that inhibits carburization and coke formation rates;

(II) To provide a treated surface layer having a precisely controlled composition and depth profile;

(III) To provide a treated surface layer that is uniformly protective and relatively free of defects; and (IV) To provide a treated surface layer that is adherent and possesses a low tendency to crack, peel, or degrade at high temperature.

SUMMARY OF INVENTION

In accordance with the objects of the present invention, there is provided a treatment method to obtain a precisely controlled surface composition on a substrate to form a uniformly protective surface layer that inhibits coking and carburization and possesses low tendency for cracking, peeling and degradation at the high temperature conditions typical of thermal cracking processes. Antifoulants selected from a group of primary elements consisting of aluminum, silicon, and chromium, or a combination thereof, and a group of secondary elements consisting of calcium, lithium, magnesium, cesium, hafnium, yttrium or zirconium, or combinations thereof are ion implanted into the surface of the metal substrate to form a durable oxide film. The oxide film consists primarily of $Al_2O_3$, $SiO_2$, $Cr_2O_3$ or combinations thereof, and contains lesser concentrations of secondary elements that enhance the durability and coke-inhibiting quality of the treated surface layer.

It is a further object of the invention to provide a method for reducing carburization, oxidation, and the formation of coke on a metal object having a surface exposed to hydrocarbon at high temperature in a thermal cracking process, that includes:

a) providing ion implanting apparatus, b) operating the apparatus to ion implant selected antifoulant or antifoulants into the metal object surface, c) the metal object configured to have its ion implanted surface exposed to hydrocarbon at high temperature in the thermal cracking process.

Another object is to provide for generation of a plasma containing ions of the antifoulant or antifoulants, and exposing the metal object surface to the plasma, under vacuum conditions.

A further object is to provide the treated object in the form of a reactor pipe sized to flow a stream of hydrocarbon in a thermal cracking process furnace, and operation includes relatively moving the plasma and pipe, lengthwise of the pipe, to substantially uniformly treat the pipe bore with the plasma, and for a time period to achieve ion implant.

An additional object is to-provide antifoulants that comprise:

i) a primary element or elements selected from a first group comprising aluminum, silicon and chromium, and ii) a secondary element or elements selected from a second group comprising calcium, potassium, lithium, magnesium, cesium, hafnium, yttrium or zirconium.

As will be seen the primary element or elements of the first group of elements are ion implanted at doses in the range $1\times10^{17}$ ion/cm$^{-2}$ to $1\times10^{18}$ ion/cm$^{-2}$; also the secondary element or elements are ion implanted at doses in the range 0 to $5\times10^{16}$ ion/cm$^{-2}$, and wherein the secondary element or elements are ion implanted pursuant to one of the following:

$x^1$) subsequent to ion implantation of the primary element or elements, $x^2$) concomitant with ion implantation of the primary element or elements.

Yet another object is to generate and use one of the following for ion implantation:

i) directed beam ion implantation ii) plasma source ion implantation iii) plasma immersion ion implantation and deposition iv) ion translation from an ion source onto the surface of said object.

These and other objects and advantages of the invention, as well as the details of an illustrative embodiment, will be more fully understood from the following specification and drawings, in which:

DRAWING DESCRIPTION

DETAILED DESCRIPTION

Figure 1:
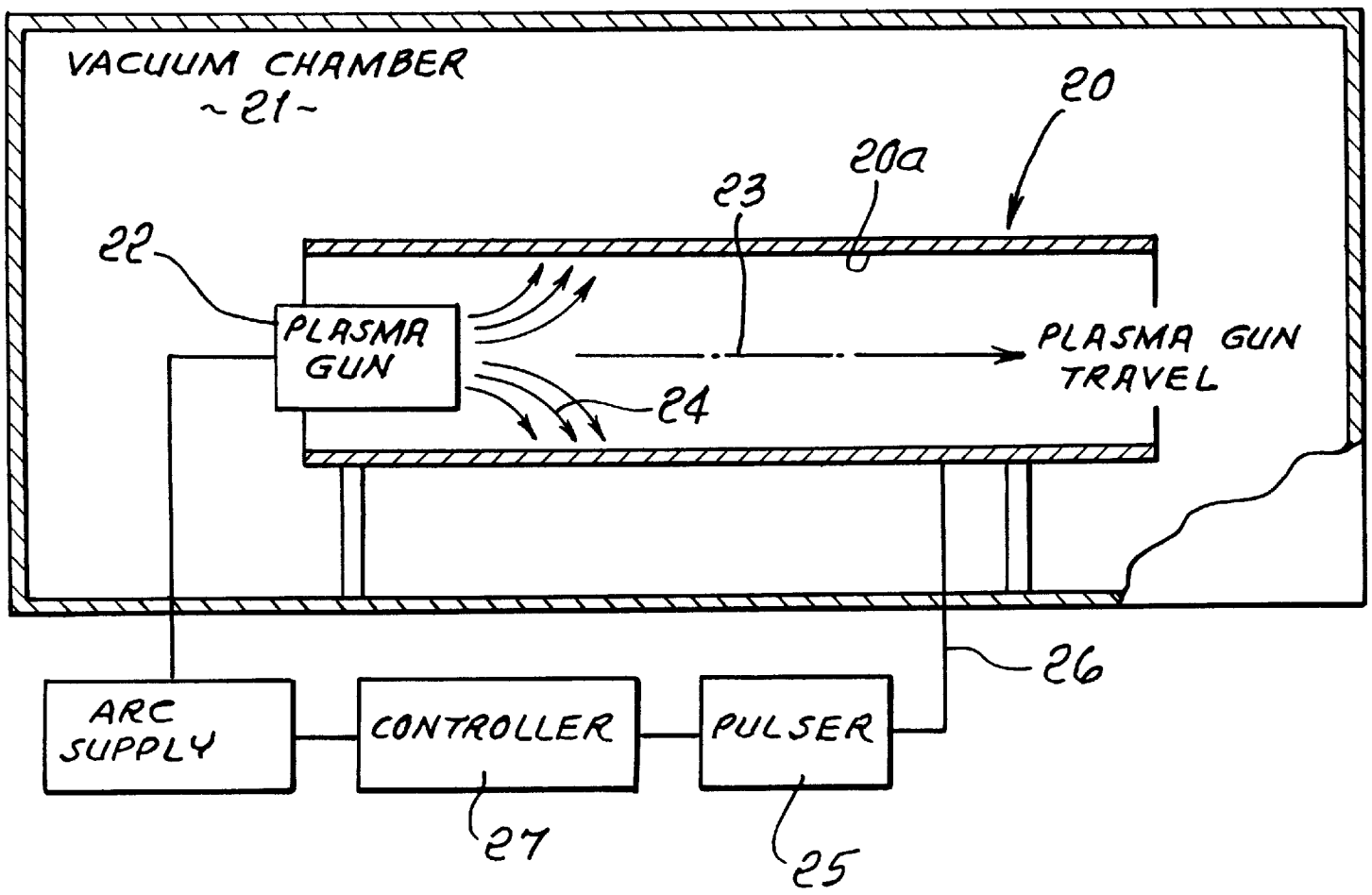
FIG. 1 is a diagrammatic illustration of the method and use of ion implantation for the treatment of the inside of a furnace tube.

In the invention, by "ion implantation of antifoulants for reducing coke formation" is meant the process of atomically incorporating antifoulant atomic elements of coke-inhibiting quality into a substrate or substrates by accelerating plasma ions to sufficiently high energy levels that the plasma ions ballistically penetrate the substrate surface and are retained within a shallow subsurface layer thereby intimately and uniformly mixing the antifoulant atoms with the substrate atoms; also in the invention, by "ion implantation of antifoulants for reducing coke formation" is meant the process of atomically incorporating elements of coke-inhibiting quality into substrates by bombarding a thin film of antifoulant material deposited on the substrate with energetic ions to intermix the antifoulant atoms with the substrate atoms, said thin film having been produced by plasma deposition, chemical vapor deposition or other deposition methods.

The antifoulants are chosen from a primary group of primary elements consisting of aluminum, silicon and chromium, or combinations thereof that are implanted into the substrate at concentrations in the range of $1\times10^{17}$ ion/cm$^2$ to $1\times10^{18}$ ion/cm$^2$. The antifoulants may also include mixtures of said chosen primary elements and secondary elements chosen from a secondary group consisting of calcium, lithium, potassium, magnesium, cesium, hafnium, yttrium and zirconium, or combinations thereof. Said chosen secondary elements are implanted into the substrate at concentrations in the range of $5\times10^{15}$ ion/cm$^2$ to $5\times10^{16}$ ion/cm$^2$. Ion implantation of said secondary elements can be conducted simultaneous to ion implantation of said primary elements, or subsequent to implantation of. said primary elements. The primary and secondary element ions are implanted at an energy range of 5 keV to 500 keV.

Laboratory studies conducted in the development of this invention show that the ion implantation of aluminum in a heat resistant alloy such as Incoloy 800H produces a strongly bonded $Al_2O_3$ surface layer that substantially reduces the rate of carburization and coke formation at the substrate surface during pyrolysis of hydrocarbons both in the presence and absence of steam, and substantially reduces the rate of oxidation and metal loss during repeated coking and decoking cycles. These laboratory studies indicate that the impervious $Al_2O_3$ surface layer prevents the migration of catalytic metals from the substrate surface to the growing catalytic coke filaments. Silicon and chromium are known to form an impervious oxide film or films with protective qualities similar to $Al_2O_3$and by extension are equally well suited for use as an ion implantable antifoulant to reduce coke deposits in thermal cracking. processes.

Laboratory studies conducted in the development of this invention also show that the ion implantation of secondary group elements calcium and lithium in Incoloy 800H inhibits coke-formation in the presence of steam, but increases coking rates in the absence of steam. It is well known in the art of carbon gasification that alkaline and alkaline earth elements promote the gasification of carbon by catalytic reaction with steam. Laboratory studies conducted herein further show that ion implantation of lithium and calcium in Incoloy 800H without prior or simultaneous ion implantation of antifoulants selected from said group of primary elements results in accelerated rates of oxidation and corrosion of the Incoloy 800H substrate. These accelerated rates of oxidation and corrosion are undesirable. In this invention, the beneficial catalytic properties of alkaline and alkaline earth elements for promoting steam gasification of carbon are retained without negative impact on oxidation and corrosion rates by simultaneously ion implanting antifoulants selected from said group of primary elements and antifoulants selected from alkaline and alkaline earth elements, including but not limited to lithium, potassium, calcium and magnesium, or by implanting antifoulants selected from said primary group followed by subsequent ion implantation of said alkaline and alkaline earth antifoulants.

It is known in the art that the adherence and corrosion resistance of $Al_2O_3$ protective films can be enhanced by incorporation of certain promoters in small concentrations including cesium, hafnium, yttrium and zirconium using chemical vapor deposition and thermal diffusion processes. In this invention, ion implantation is used to incorporate said promoters to further enhance the adherence and corrosion resistance of use of $Al_2O_3$, $SiO_2$, and $Cr_2O_3$ protective films formed using ion implantation.

The invention includes but is not limited to the ion implantation of selected antifoulants using directed beam ion implantation and/or plasma source ion implantation, and/or plasma immersion ion implantation and deposition. Directed beam ion implanters generate a unidirectional beam of high energy ions that are directed at the substrate surface. These implanters are generally most well suited to the treatment of planar substrates.

Plasma source ion implantation and plasma immersion ion implantation and deposition enable implantation of non-planer shapes because ions are accelerated from all directions toward the surface normal of the target. The specimen is immersed within a plasma and is subjected to a negative pulsed bias voltage that accelerates ions through an electrical sheath and into the specimen surface. The method eliminates the need for particle accelerators and allows the simultaneous treatment of large surface areas.

In plasma source ion implantation, a weakly ionized plasma of the implant species is established in a vacuum chamber using a radio frequency generator or other suitable plasma generation source. The process requires that the implant species be in a-gaseous form. For example silicon can be implanted using gaseous silicon containing compounds such as silane, disilane, and chlorosilane.

In the preferred embodiment of the invention, plasma immersion ion implantation and deposition is used to treat the surface of heat resistant alloys such as furnace tube bores, with selected antifoulants. A cathodic arc plasma source is used to generate dense, highly ionized plasma from a wide range of condensable elements. Because the cathode provides the source of the plasma ions, the implant composition can be easily controlled by adjusting the cathode composition. To generate dense plasma from cathode elements of low electrical conductivity, the cathode can be doped with conductive metals.

The plasma generated from the cathode plumes toward the substrate with a streaming energy of order 100 eV. The substrate is repeatedly pulse-biased to a negative voltage in the range of 5 kV to 50 kV, thereby accelerating a portion of the incident ion flux that bombards the substrate surface. Low energy plasma deposition occurs at the specimen surface between the voltage pulses; while direct and recoil ion implantation and sputtering of the deposited layer occurs during the voltage pulses. By varying the pulse bias voltage and duty cycle (ratio of voltage pulse on/off time), the concentration depth profile of the implanted/deposited species can be varied over a wide range. FIG. 1 is a diagrammatic illustration of the use of plasma immersion ion implantation and deposition for treating the inside of a furnace tube. The furnace tube 20 to be treated is shown as placed inside of a vacuum chamber 21 to conduct the ion implantation process, or the furnace tube can be enclosed at its two ends and evacuated to form an internal vacuum space for ion implantation. In both cases the cathodic arc plasma source such as gun 22 is translated down the axis 23 of the tube to uniformly treat the tube bore 20*a*, along the tube length while the tube bore or surface is repeated pulse biased to a negative voltage. The plasma is shown at 24, and the pulser 25 is connected at 26 to the tube 20. A pulser controller is shown at 27, to control the pulse bias voltage and the duty cycle.

The invention is further illustrated by the following examples that are exemplary of the specific aspect of practicing the invention, and should not be, taken as limiting the scope of the invention defined by the appended claims.

EXAMPLE 1

Figure 2:
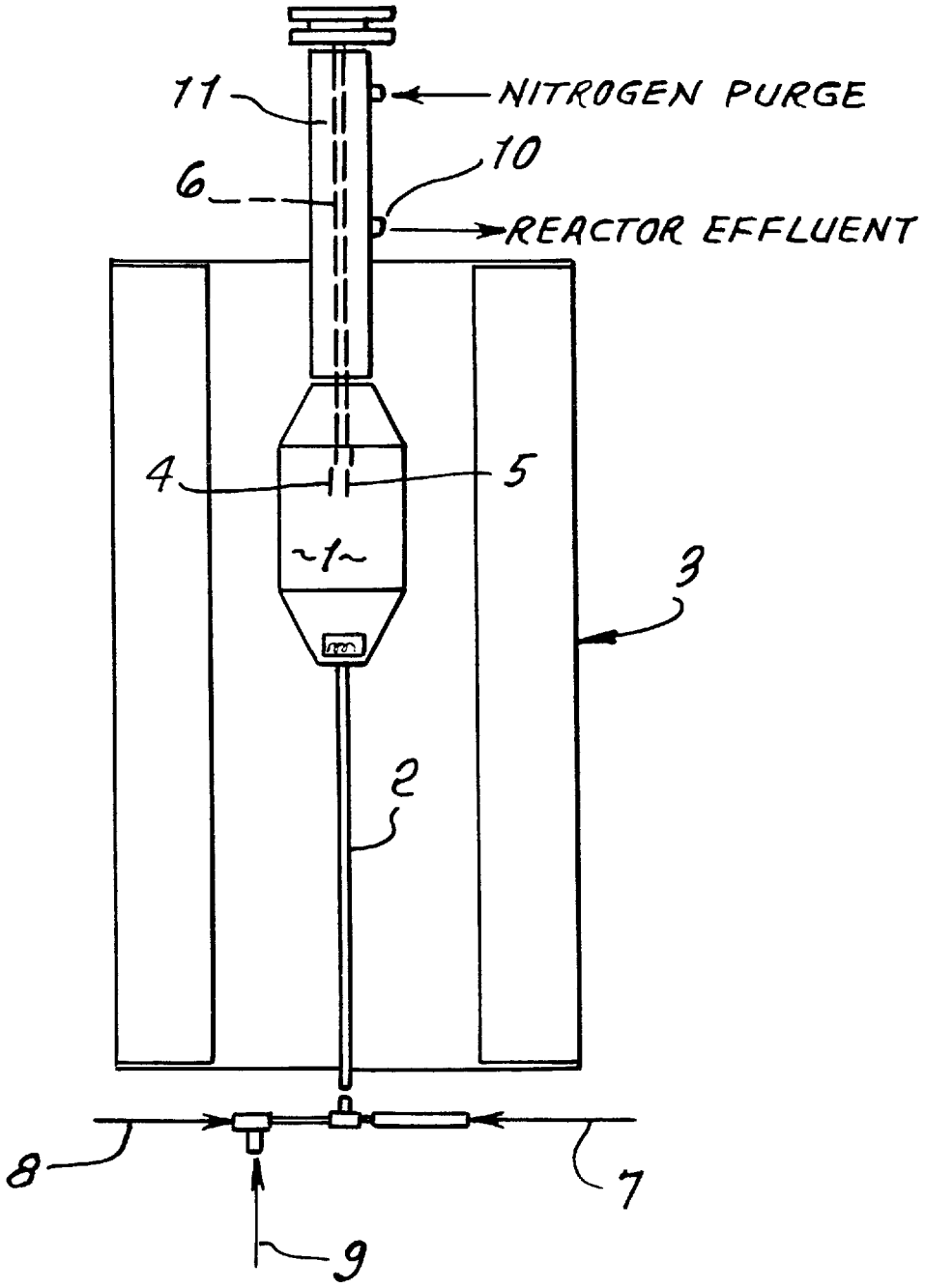
FIG. 2 is a diagram of the test apparatus used to test the antifoulants of the present invention.

The laboratory apparatus described in FIG. 2 was used to illustrate the benefits of the invention. A reactor 1 and preheat coil 2 are supported inside of an electric furnace 3. Two metal coupons 4 and 5, consisting of a treated sample and an untreated control, are supported inside of the reactor on a metal rod 6. A hydrocarbon feed stream 7 is premixed with nitrogen 8 or steam 9 before being introduced at the inlet of the preheat coil. The gaseous mixture is heated to the desired reactor temperature and coke is deposited on the metal coupons. The gases exit from the reactor through conduit means 10. The metal coupons are intermittently withdrawn from the reactor through a cooling zone 11 that is purged with nitrogen to record coke weight gain. After a coking test, a nitrogen and air mixture is introduced at the inlet of the preheat coil to burn off the coke deposits.

A 1"×5/8"×1/32" metal coupon consisting of Incoloy 800H was ion implanted with aluminum at an ion energy of 100 keV and an ion dose of $5\times10^{17}$ $cm^{-2}$. Incoloy 800H is a common material of construction for cracking tubes; however the ion implantation method is equally well suited to the hydrocarbon treatment of other high temperature metal alloys such as Inconel 600, HP-50, HK-40, and Type 304 stainless steel.

Figure 3:
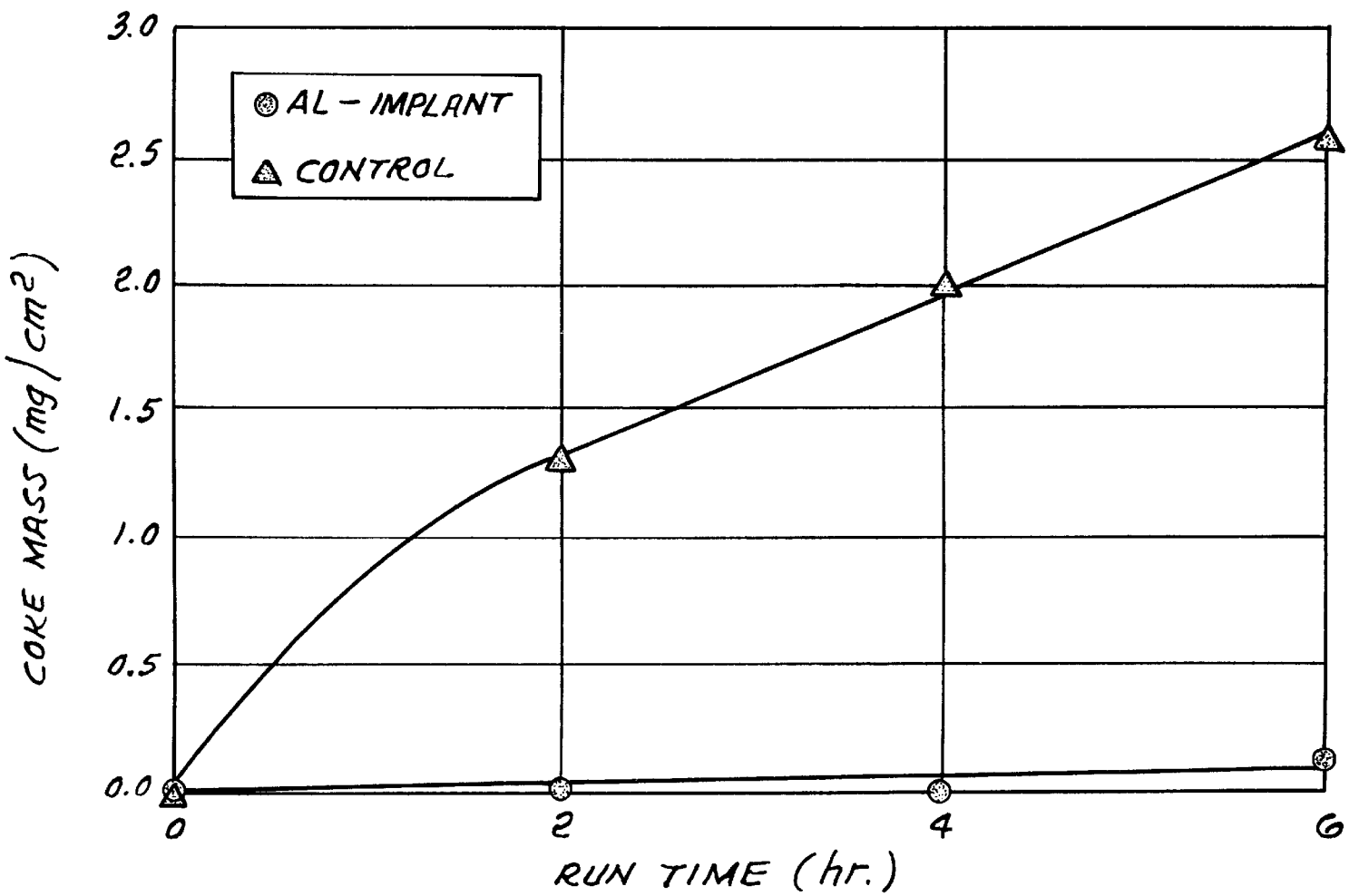
FIG. 3 is a graphical illustration of the effect of aluminum implantation on the rate of coke formation for the first coking cycle.

The aluminum-implanted coupon and an untreated Incoloy 800H control coupon were subjected to the first coking cycle at a reactor temperature of 815° C. using a mixture of ethylene and nitrogen. The coke accumulation for each of the coupons is shown at various reaction times in FIG. 3 The test results show that the aluminum-implanted coupon exhibits a substantially lower coking rate than the untreated control.

EXAMPLE 2

Figure 4:
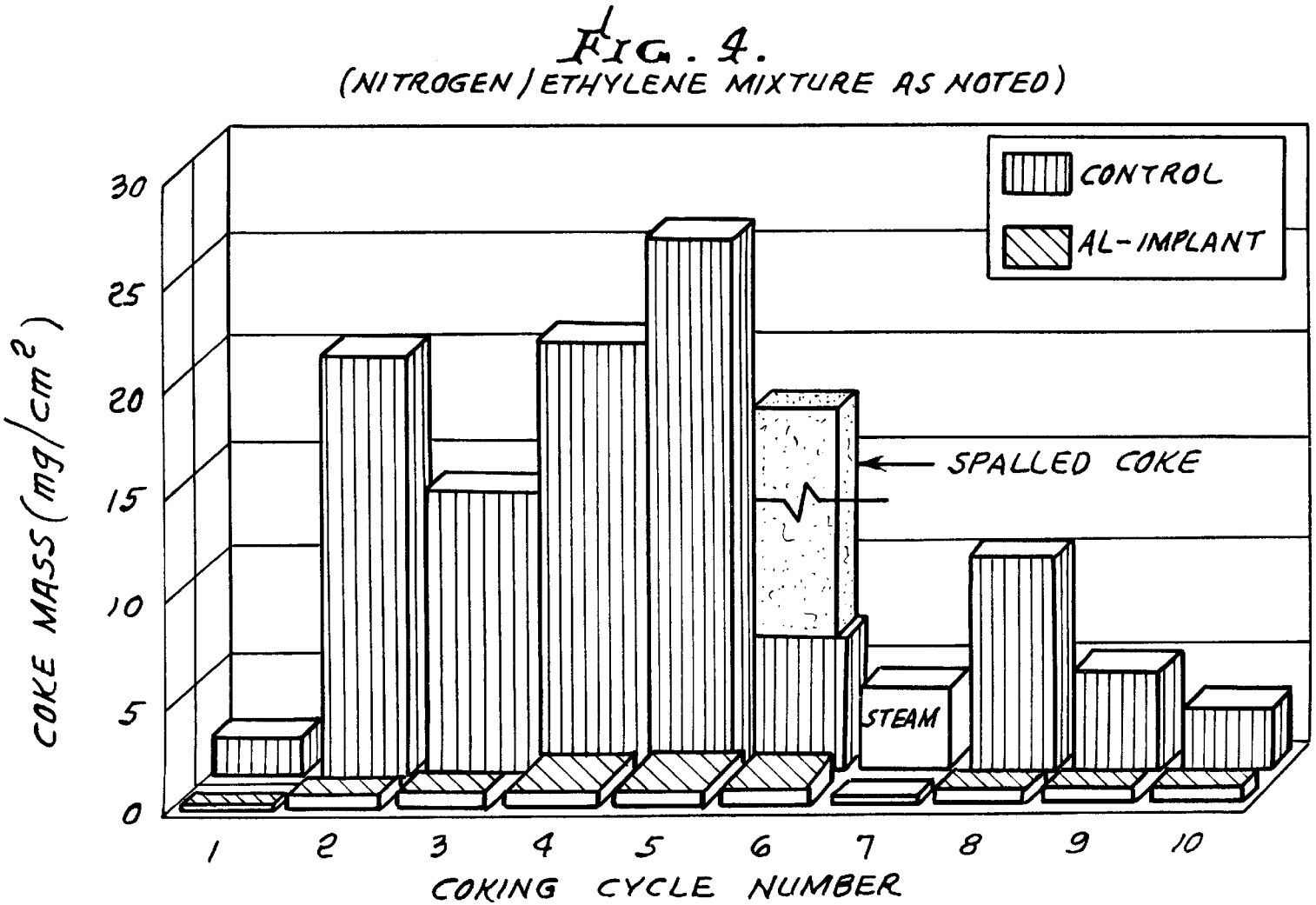
FIG. 4 is a graphical illustration of the effect of aluminum implantation on coke formation for repeated coking and decoking cycles.
Figure 5:
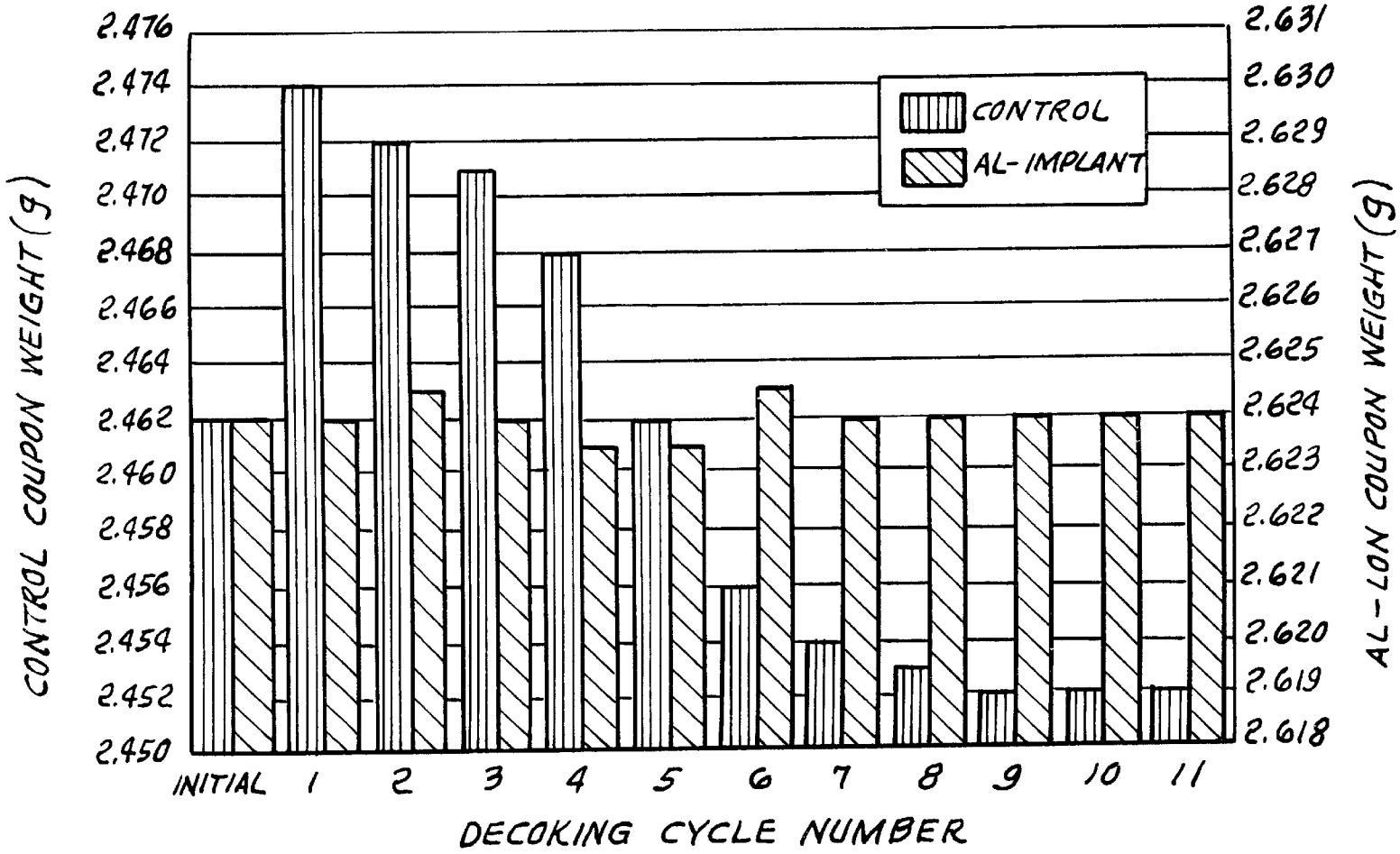
FIG. 5 is a graphical illustration of the effect of aluminum-implantation on coupon weight gain and loss after successive decoking cycles.

Using the apparatus and process conditions of Example 1, a series of coking and decoking test cycles were conducted to illustrate the durability of the treatment method of the invention. An aluminum-implanted coupon and a control coupon were subjected to 10 successive 4-hour coking cycles. Each coking cycle was followed by a subsequent decoking step to remove accumulated deposits. The results of the sequential coking tests are presented in FIG. 4 The results show that the aluminum-implanted coupon retains its ability to inhibit coking over many coking and decoking cycles. FIG. 5 depicts the weight gain and loss of the metal coupons after repeated decoking cycles. The untreated control coupon shows a high initial weight gain after the first decoking cycle due to oxidation of the metal surface.

Thereafter, the. coupon shows a progressive loss in weight due to the attrition of metal that results from the formation of catalytic coke. However, the aluminum-implanted sample shows very little oxidation or metal attrition as evidenced by its near constant weight over many decoking cycles. This phenomenon is thought to be due to the presence of an impervious $Al_2O_3$ scale that forms on the aluminum-implanted surface. The $Al_2O_3$ scale prevents the diffusion of carbon into the substrate surface and the diffusion of metal out of the substrate surface, thereby interfering with the normal mechanism of catalytic coke growth. Other elements such as chromium and silicon are also capable of forming impervious oxide scales. By logical extension, the ion implantation of silicon and chromium into metals is expected to have similar benefits for the reduction of coke formation.

EXAMPLE 3

Figure 6:
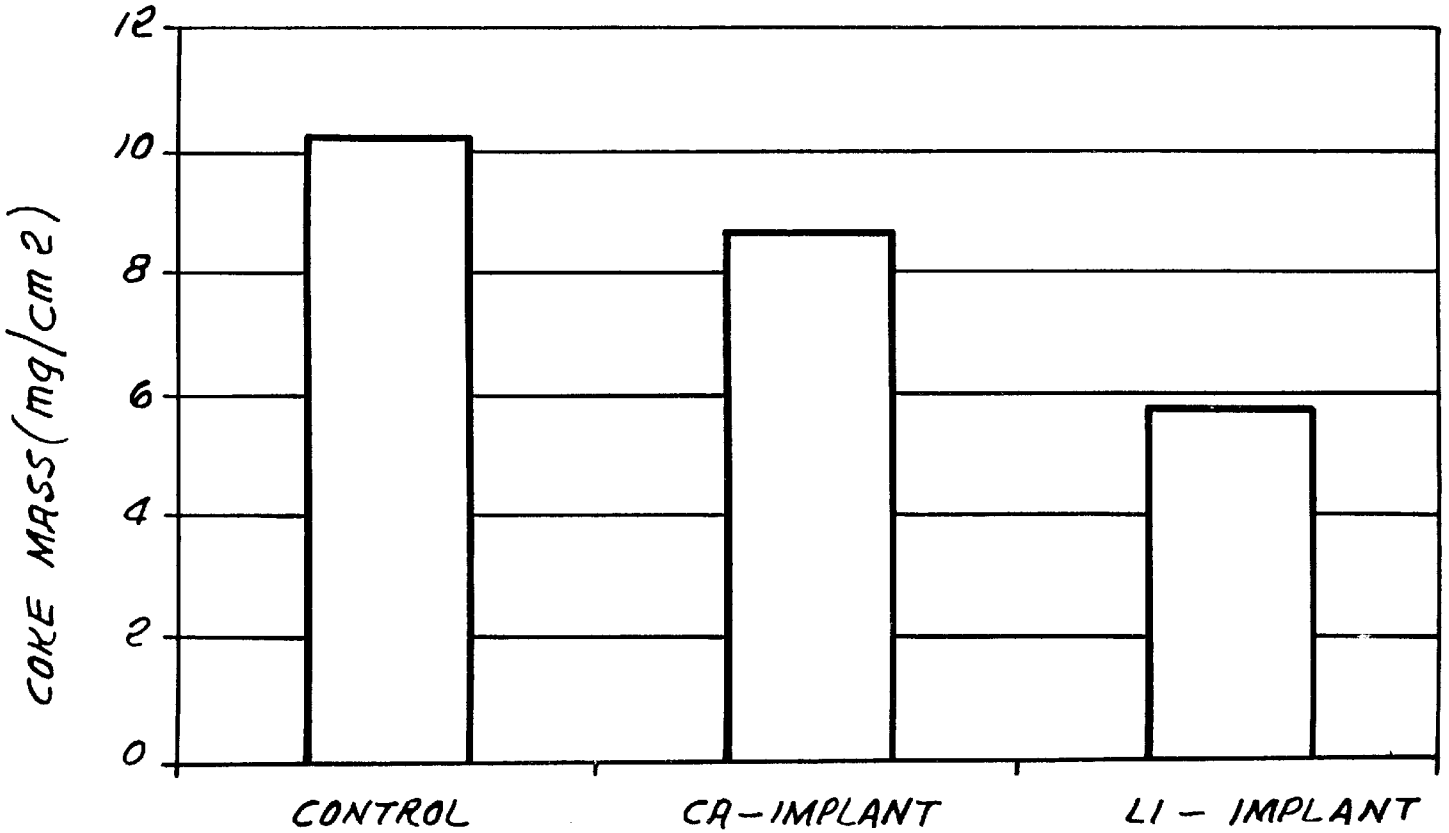
FIG. 6 is a graphical illustration of the effect of calcium and lithium implantation on coke formation using nitrogen and steam diluent.

Using the apparatus of Example 1, calcium-implanted, lithium-implanted, and-control coupons were coked for a 4-hour period at 815° C. using a mixtures of ethylene and steam. FIG. 6 shows that the mass of coke deposited is lower for the calcium-implanted and lithium-implanted coupons compared to the Incoloy 800H control coupon. Conversely, coking rates for calcium-implanted and lithium-implanted coupons were found to be higher than for the control coupon for tests conducted using a mixture of ethylene and nitrogen. The results indicate that ion implantation of calcium and lithium enhances the steam gasification of carbon deposits on the substrate surface.

Figure 7:
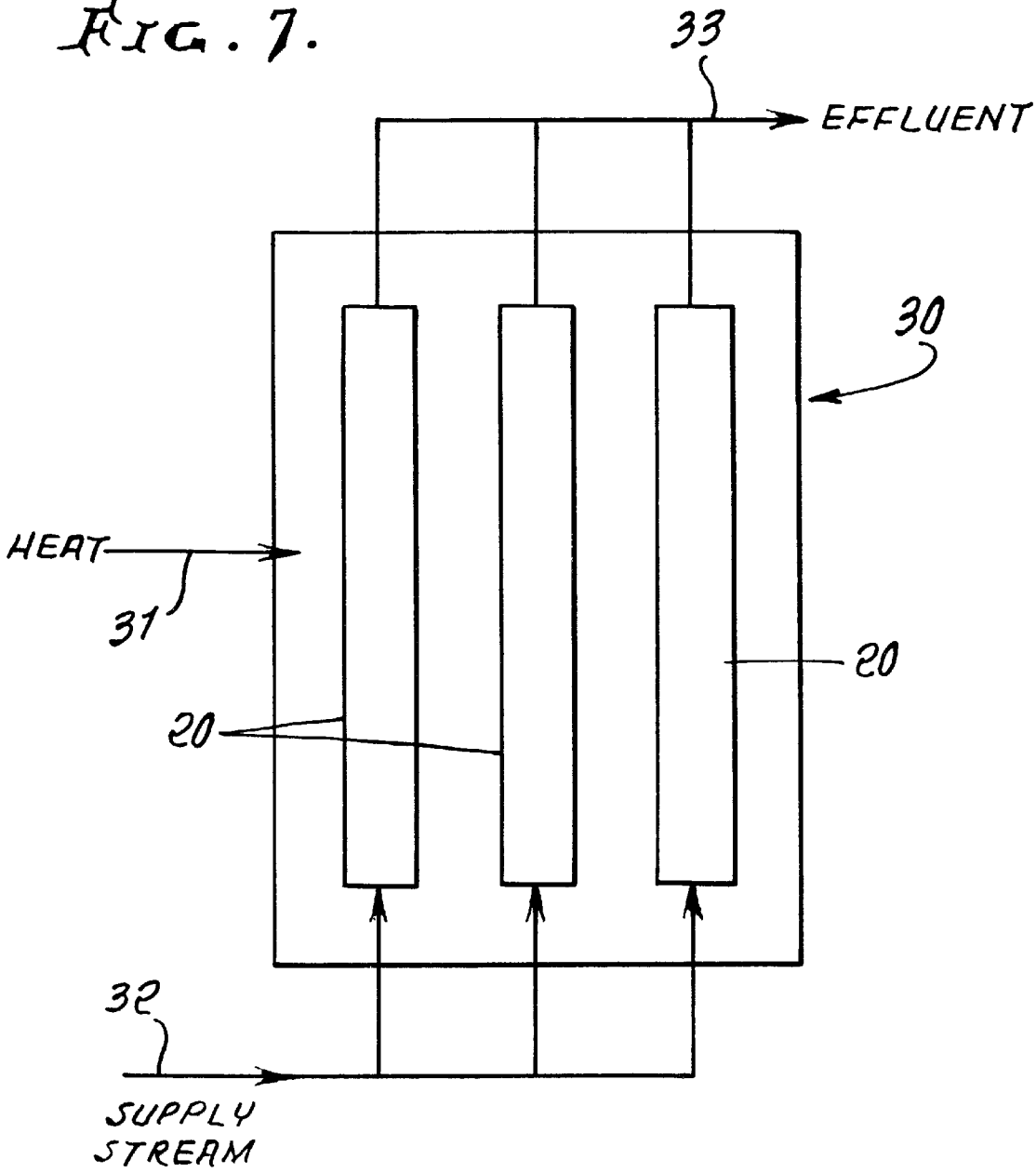
FIG. 7 is a view showing use of a treated tube or tubes in a hydrocarbon cracking process.

FIG. 7 shows use of a treated tube 20 or tubes in a hydrocarbon cracking process. The vertical tubes 20 are located in a furnace 30, to which heat is supplied at 31. A hydrocarbon stream 32 is fed to the tube or tubes, and product effluent gases are removed at 33.

Reasonable variations and modifications are possible by those skilled in the art within the scope of the described invention and the appended claims.

We claim:

1. The method for reducing carburization, oxidation, and the formation of coke on a metal object having an elongated surface exposed to hydrocarbon at high temperature in a process, that includes:

a) providing ion implanting apparatus, b) operating said apparatus to ion implant selected antifoulant or antifoulants into the metal object surface, progressively along said surface, c) said metal object configured to have said ion implanted surface exposed to said hydrocarbon at high temperature in said process, d) said apparatus including a cathodic arc plasma gun which is relatively translated progressively lengthwise of said surface while producing a plasma acting to uniformly ion implant said surface lengthwise thereof.

2. The method of claim 1 wherein said operating includes generating a plasma containing ions of said antifoulant or antifoulants, and exposing said metal object surface to said plasma, under vacuum conditions.

3. The method of claim 2 wherein said object comprises a metallic reactor pipe sized to flow a stream of hydrocarbon in a thermal cracking process furnace, and said operating includes relatively moving said plasma and pipe, lengthwise of the pipe, to substantially uniformly treat the pipe bore with said plasma, and for a time period to achieve said ion implant.

4. The method of claim 1 wherein said antifoulants comprise:

i) a primary element or elements selected from a first group comprising aluminum, silicon and chromium, and ii) a secondary element or elements selected from a second group comprising calcium, lithium, potassium, magnesium, cesium, hafnium, yttrium and zirconium.

5. The method of claim 4 wherein said primary element or elements are ion implanted at doses in the range $1\times10^{17}$ [$cm^{-2}$] to $1\times10^{18}$ [$cm^{-2}$]

ions per square centimeter of pipe bore surface and said secondary element or elements are ion implanted at does in the range 0 to $5\times10^{16}$ ions per square centimeter of pipe bore surface, and wherein said secondary element or elements are ion implanted pursuant to one of the following:

$x^1$) subsequent to ion implantation of said primary element or elements, $x^2$) concomitant with ion implantation of said primary element or elements.

6. The method of claim 5 wherein said secondary-element or elements are ion implanted at doses in the range 0 to $5\times10^{16}$ $cm^{-2}$, and wherein said secondary element or elements are ion implanted pursuant to one of the following:

$x^1$) subsequent to ion implantation of said primary element or elements, $x^2$) concomitant with ion implantation of said primary element or elements.

7. The method of claim 1 wherein said operating includes generating and using one of the following for ion implantation:

i) directed beam ion implantation ii) plasma source ion implantation iii) plasma immersion ion implantation and deposition iv) ion translation from an ion source onto the surface of said object whereby mixing of the implant ions and the atoms of the object surface is achieved.

8. The method of claim 7 wherein generated ion energies in the range of 5 keV to 500 keV are utilized for implantation.

9. The method in accordance with claim 1 wherein ion implantation is conducted using a cathodic arc plasma source that is placed in an evacuated space formed by the inside of the furnace tube which is sealed at both ends to generate a low energy plume of dense plasma consisting of selected antifoulants, said cathodic arc plasma source being traversed down the axis of the furnace tube to uniformly ion implant antifoulants into the tube surface by applying to the tube a repeated negative voltage pulse in the range of 5 kV to 50 kV.

10. The method of claim 1 wherein an oxide film is produced at said ion implanted object surface.

11. The method of claim 3 that further includes locating said reactor pipe in said thermal cracking process furnace, heating said pipe in said furnace, and passing hydrocarbon through said pipe to achieve thermal cracking of the hydrocarbon.

12. The method for reducing carburization, oxidation, and the formation of coke on a metal object having a surface exposed to hydrocarbon at high temperature in a process, that includes:

a) providing ion implanting apparatus, including a plasma source, b) operating said apparatus to ion implant selected antifoulant or antifoulants into the metal object surface, progressively along said surface c) said metal object configured to have said ion implanted surface exposed to said hydrocarbon at high temperature in said process, d) said object comprising a metallic reactor pipe sized to flow a stream of hydrocarbon in a thermal cracking process furnace, and said operating including relatively moving said plasma source and pipe, lengthwise of the pipe, to substantially uniformly treat the pipe bore with said plasma, and for a time period to achieve said ion implantation, e) said antifoulants comprising i) a primary element or elements selected from a first group comprising aluminum, silicon and chromium, and ii) a secondary element or elements selected from a second group comprising calcium, lithium, postassium, magnesium, cesium, hafnium, yttrium and zirconium, f) said primary element or elements being ion implanted at doses in the range, $1\times10^{17}$ to $1\times10^{18}$ ions per square centimeter of pipe bore surface and said secondary element or elements being ion implanted at doses in the range 0 to $5\times10^{16}$ ions per square centimeter of pipe bore surface, and wherein said secondary element or elements are ion implanted pursuant to one of the following:

$x_1$ subsequent to ion implantation of said primary element or elements, $x_2$ concomitant with ion implantation of said primary element or elements.

13. The method of claim 12 including flowing a stream of said hydrocarbon through said bore of the reactor pipe, at high temperature, in a thermal cracking furnace, whereby coke formation is reduced.

14. The method of claim 1 including flowing a stream of said hydrocarbon adjacent said ion implanted surface of said metal object, at high temperature, in a thermal cracking furnace, whereby coke formation is reduced.

15. The method for reducing carburization, oxidation, and the formation of coke on a metal object having a surface exposed to hydrocarbon at high temperature in a process, that includes:

a) providing ion implanting apparatus, b) operating said apparatus to ion implant selected antifoulant or antifoulants into the metal object surface, progressively along said surface, c) said metal object configured to have said ion implanted surface exposed to said hydrocarbon at high temperature in said process, d) said operating including generating a plasma containing ions of said antifoulant or antifoulants, and exposing said metal object surface to said plasma, under vacuum conditions, e) said object comprising a metal reactor pipe sized to flow a stream of hydrocarbon in a thermal cracking process furnace, and said operating including relatively moving said plasma and pipe, lengthwise of the pipe, to substantially uniformly treat the pipe bore with said plasma, and for a time period to achieve said ion implant, f) and including locating said reactor pipe in said thermal cracking process furnace, heating said pipe in said furnace, and passing hydrocarbon through said pipe to achieve thermal cracking of the hydrocarbon.

* * * * *

UNITED STATES PATENT AND TRADEMARK OFFICE

CERTIFICATE OF CORRECTION

PATENT NO. : 6,544,406 B1 
DATED : April 8, 2003
INVENTOR(S) : David W. Warren and Michael B. Donahue It is certified that error appears in the above-identified patent and that said Letters Patent is hereby corrected as shown below:

Column 8,
Line 11, "secondary element or elements are ion implanted at does in", should read -- secondary element or elements are ion implanted at doses in --

Signed and Sealed this

Seventh Day of October, 2003

JAMES E. ROGAN
*Director of the United States Patent and Trademark Office*